United States Patent [19]

Burton

[11] 4,256,044

[45] Mar. 17, 1981

[54] AIR-FUEL MIXING DEVICE

[75] Inventor: Gordon D. Burton, Chagrin Falls, Ohio

[73] Assignee: Ferro Corporation, Cleveland, Ohio

[21] Appl. No.: 33,691

[22] Filed: Apr. 26, 1979

[51] Int. Cl.[3] ..... F23K 3/02

[52] U.S. Cl. ..... 110/104 R; 110/347

[58] Field of Search ..... 110/104 R, 105, 263, 110/347; 34/57 R; 406/62-68, 86, 108, 122, 123, 142

[56] References Cited

U.S. PATENT DOCUMENTS

| | | | |
|---|---|---|---|
| 3,986,271 | 10/1976 | Andrews | 34/57 R |
| 4,092,094 | 5/1978 | Lingl, Jr. | 110/104 R |
| 4,131,072 | 12/1978 | Lingl, Jr. et al. | 406/123 |

FOREIGN PATENT DOCUMENTS

| | | | |
|---|---|---|---|
| 525437 | 5/1956 | Belgium | 406/142 |

*Primary Examiner*—Charles A. Ruehl

*Attorney, Agent, or Firm*—Baldwin, Egan, Walling & Fetzer

[57] ABSTRACT

An air-fuel mixing device for mixing solid pulverized fuel with air in preselected ratios prior to combustion including an upstanding hollow tube forming an air-fuel mixing chamber, with a table disposed in the tube intermediate the top and bottom ends thereof whereby the table edges are spaced from the walls of the tube to provide an air passageway therebetween. A fuel feeder feeds pulverized fuel into the top of the tube thence onto the table and off the edges thereof in preselected amounts. A blower feeds pressurized air into the lower end of the tube and then upwardly past the table edges whereby such upwardly flowing air catches the pulverized fuel overflow from the table and mixes therewith to form an air-fuel mixture which is channeled from the tube to associated fuel burners.

10 Claims, 5 Drawing Figures

AIR-FUEL MIXING DEVICE

This invention relates to air-fuel mixing devices, and more particularly to an air-fuel mixing device that mixes air and solid pulverized fuel in preselected amounts and channels such air-fuel mixture to associated fuel burners.

BACKGROUND OF THE INVENTION

There has long been a need, particularly with the advent of the energy crisis, for a simple device that efficiently mixes air and any type of solid pulverized fuel in predetermined amounts. Prior devices include complicated mechanisms such as multiple baffles, carburetor-type structures, multiple valves, etc., which are highly complicated and most expensive. Additionally, such prior devices are limited to mixing only certain types of pulverized fuel. There is a dire requirement for a simple device that mixes air with any type of solid pulverized fuel such as pulverized coal, sawdust, pulverized corn husks, dried sewage, etc.

SUMMARY OF THE INVENTION

An object of the invention is to provide an air-pulverized fuel mixing device that is simple in construction, inexpensive to manufacture and highly effective in operation.

A further object of the invention is to provide an air-pulverized fuel mixing device of the above type that mixes air with solid pulverized fuel of any type.

Briefly, the foregoing objects are accomplished by the provision of an air-fuel mixing device for mixing solid pulverized fuel with air in preselected ratios prior to combustion including an annular upstanding hollow tube forming an air-fuel mixing chamber. An annular table is disposed in the tube intermediate the top and bottom ends thereof, whereby the table edges are spaced from the walls of the tube to provide an air passageway therebetween. A feed hopper containing solid pulverized fuel is disposed above the tube. A fuel feeder is operatively secured to the bottom of the hopper and has an outlet conduit extending into the top of the tube for feeding pulverized fuel from the feed hopper and thence into the tube and onto the table and off the edges thereof in predetermined amounts or continually varying amounts and/or, fixed amounts according to required burner intensity as determined by process requirements. The fuel feeder is a rotary valve type feeder having a positive displacement type axially rotatable rotor. Variable speed drive means is provided for selectively controlling the speed of rotation of the rotor for feeding pulverized fuel to the tube and table in predetermined amounts, such positive displacement rotor structure forestalling flow of air-fuel mixture upwardly through the fuel feeder outlet conduit. An exterior annular casing is provided having top, bottom and side walls forming a flow chamber. The upstanding hollow tube is disposed in the flow chamber and is secured substantially centrally to the bottom wall thereof. The casing bottom wall is annular and has a plurality of circumferentially disposed outer outlet apertures disposed adjacent the outer periphery of the casing bottom wall exteriorly of the tube forming flow chamber outlets. The casing bottom wall also has a plurality of circumferentially disposed inner inlet apertures disposed interiorly of the tube forming inlets for pressurized air entering the lower end of the tube. An annular internal cone is disposed interiorly of the flow chamber and is secured to the exterior of the upstanding hollow tube. The cone extends downwardly and outwardly from the upper portion of the tube to a position adjacent the inner edge of the flow chamber outlets to channel air-fuel mixture through the flow chamber and thence to the flow chamber outlets. Inverted "V"-shaped baffles are disposed on the casing bottom wall between the outlet apertures for channeling the air-fuel mixture to and through the outlet apertures. A pressurized air blower is provided having a pressurized air feeding duct leading to the inlet apertures for channeling pressurized air into the lower end of the tube and thence upwardly pass the table edges and mixing with the pulverized fuel overflow from the table thence flowing out the top of the upstanding hollow tube thence into the flow chamber and out the flow chamber outlets to associated fuel burners.

Other objects and advantages of the invention will be apparent from the following description taken in conjunction with the drawings wherein:

DESCRIPTION OF THE PREFERRED EMBODIMENT

Figure 1:
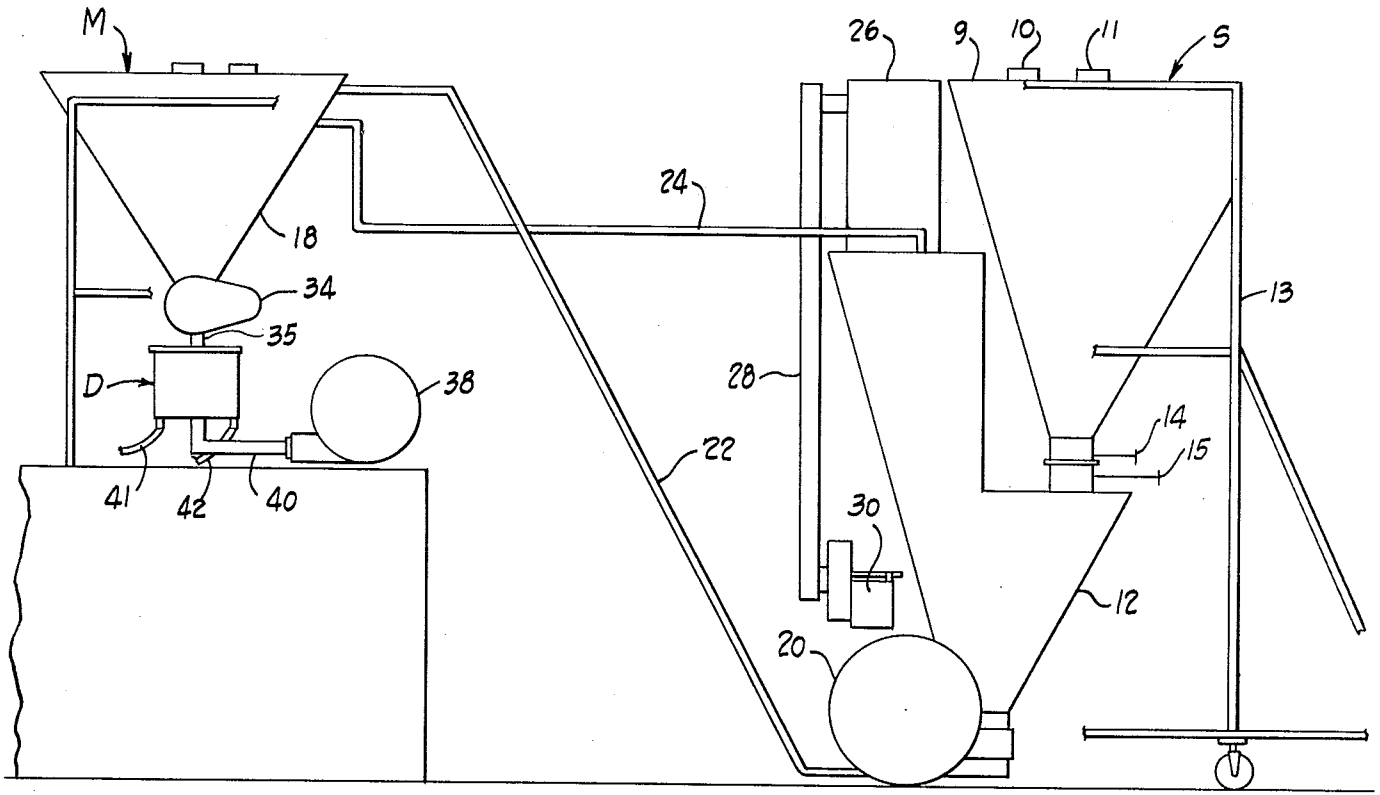
FIG. 1 is a diagrammatic view of a solid pulverized fuel supply and feeding system, and coacting air-fuel mixing mechanism incorporating the invention.

In the drawings, like numbers and letters are used to illustrate like and similar parts throughout the several views.

Referring first to FIG. 1, there is shown a diagrammatic view of a solid pulverized fuel supply and feeding system outlined on the right side of the figure and generally designated as S, and a coacting air-fuel mixing mechanism on the left side of the figure and generally designated as M. In essence, the fuel supply and feeding system S functions to supply solid pulverized fuel, as required, to the air-fuel mixing mechanism M, where the pulverized fuel is mixed with air in predetermined amounts, in accordance with the invention and then channeled to one or more furnaces for combustion.

The fuel supply and feeding system S includes a movable traveling hopper 9 containing solid pulverized fuel, such hopper 9 having suitable high-low fuel level indicators 10 and 11. The hopper 9 is supported on a movable frame 13. In operation, the hopper 9 is moved to a position over the fuel supply hopper 12, as shown in FIG. 1, at which point the valves or dampers 14 and 15 are actuated to transfer a predetermined amount of pulverized fuel from the hopper 9 to the hopper 12. From the hopper 12, the pulverized fuel is channeled to the feed hopper 18 by means of the fuel supply hopper blower 20 via the feed duct 22. A return air duct 24 connects the hoppers 12 and 18 to balance the system, such duct 24 returning pressurized air with a relatively small portion of pulverized fuel to the hopper 12, where the fuel-air separator 26 functions to separate such returned air and pulverized fuel by depositing the returned pulverized fuel in the hopper 12 and exhausting the separated air out the exhaust duct 28 by means of the exhaust fan 30. The fuel supply and feeding system S will not be further described in detail as such system, per se, forms no part of the present invention.

Referring now to the air-fuel mixing mechanism M, pulverized fuel is fed from the feed hopper 18 (by the fuel feeder 34) thence (via the conduit 35) to the air-fuel mixing device, generally designated as D, where the pulverized fuel is mixed, in preselected ratios, with pressurized air from the blower 38, which feeds pressurized air to the mixing device D through the inlet duct 40. The mixed fuel and air is then channeled from the mixing device D out the outlets 41 and 42 to one or more burners for combustion.

Figure 2:
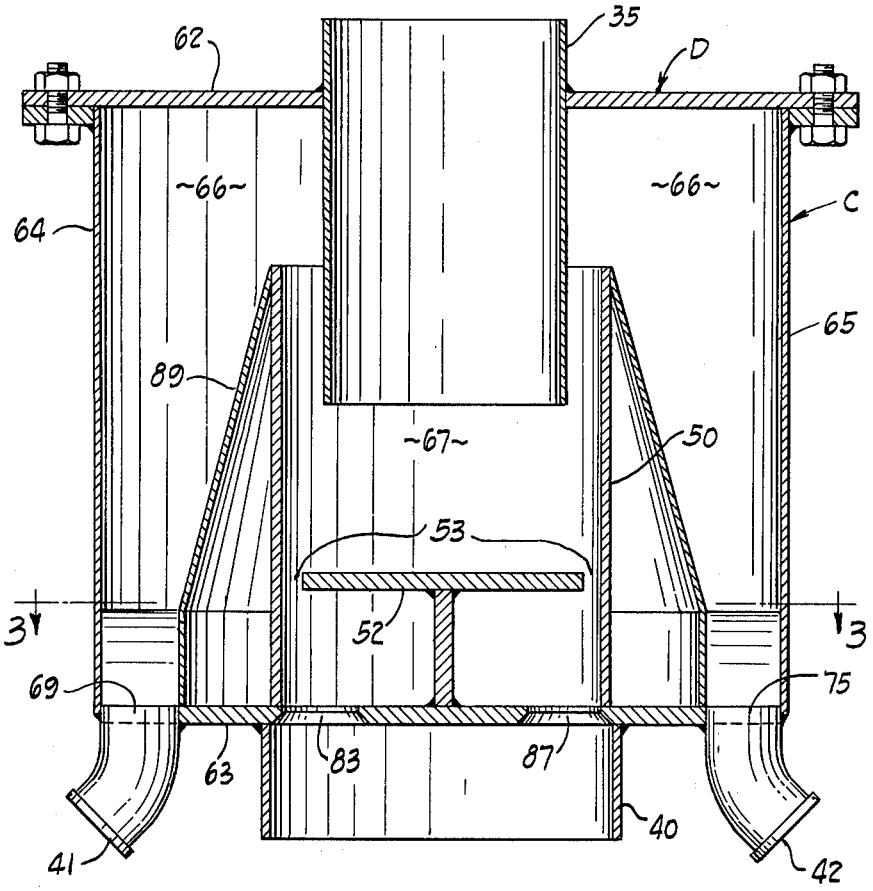
FIG. 2 is an enlarged front elevational sectional view of the air-fuel mixing device shown in FIG. 1.

The air-fuel mixing device D (FIG. 2) includes a preferably annular upstanding hollow tube 50 forming an air-fuel mixing chamber. A preferably annular table 52 is disposed in the tube 50 intermediate the top and bottom ends thereof, whereby the table edges are spaced from the walls of the tube 50 to provide an air passageway 53 therebetween. The feed hopper 18, containing solid pulverized fuel, is disposed above the tube 50. The fuel feeder 34 is operatively secured to the bottom of the hopper 18 and has the outlet conduit 35 extending into the top of the tube 50 for feeding pulverized fuel from the feed hopper 18 and thence into the tube 50 and onto the table 52 and off the edges thereof in preselected amounts.

Figure 5:
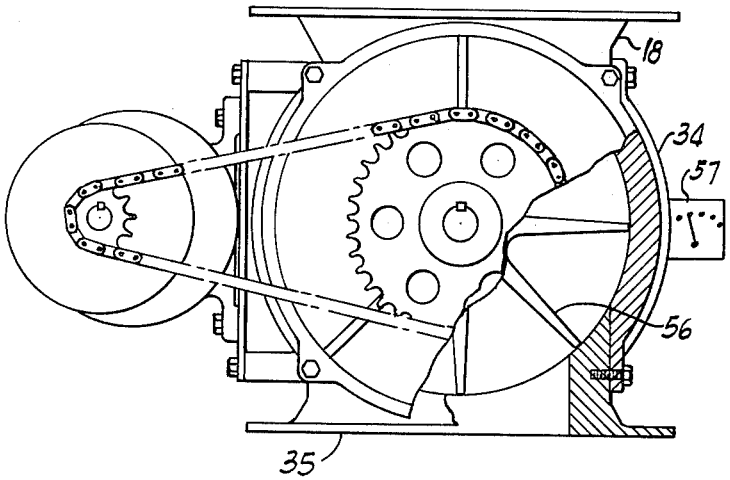
FIG. 5 is an enlarged rear elevational view, partly in section, of the fuel feeder shown in FIG. 1.

The fuel feeder 34 (FIG. 5) is a rotary valve type feeder having a positive displacement type axially rotatable rotor 56. Variable speed drive means, such as, for example, the rheostat 57, is provided for selectively controlling the speed of rotation of the rotor 56 for feeding pulverized fuel to the tube 50 and table 52 in predetermined amounts, such positive displacement rotor structure forestalling flow of air-fuel mixture upwardly through the fuel feeder outlet conduit 35. The fuel feeder 34 will not be further described in detail as such feeder, per se, forms no part of the present invention.

An exterior, preferably annular, casing generally designated as C (FIG. 2) is provided having top, bottom and side walls 62, 63, 64 and 65 respectively, forming an interior flow chamber 66. The upstanding hollow tube 50 is disposed in the flow chamber 66 and is secured substantially centrally to the bottom wall 63 thereof.

The casing bottom wall 63 (FIG. 3) is preferably annular and has a plurality of circumferentially disposed outer outlet apertures 69, 70, 71, 72, 73, 74, 75, 76, 77, 78 and 79 disposed adjacent the outer periphery of the casing bottom wall 63 exteriorly of the tube 50 forming outlets for the flow chamber 66. The casing bottom wall 63 also has a plurality of circumferentially disposed inner inlet apertures 81, 82, 83, 84, 85, 86, 87 and 88 disposed interiorly of the tube 50 forming inlets for pressurized air entering the lower end of the tube 50, from the blower 38.

A preferably annular internal cone 89 (FIG. 2) is disposed interiorly of the flow chamber 66 and is secured to the exterior of the upstanding hollow tube 50. The cone 89 extends downwardly and outwardly from the upper portion of the tube 50 to a position adjacent the inner edge of the flow chamber outlets 69 through 79, to channel air-fuel mixture through the flow chamber 66 and thence to such flow chamber outlets.

Figure 3:
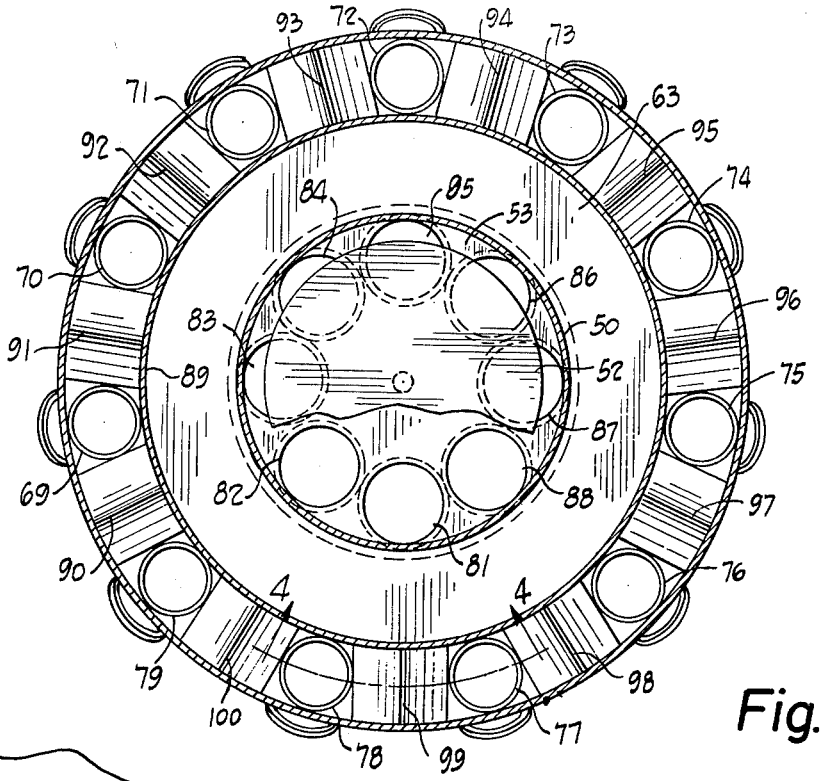
FIG. 3 is a view taken along the line 3—3 of FIG. 2.
Figure 4:
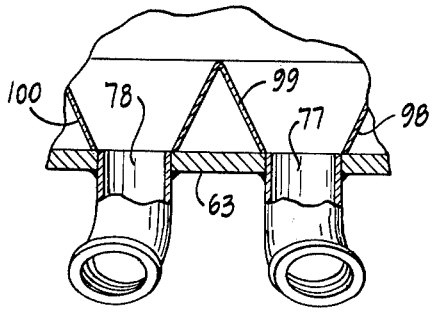
FIG. 4 is a view taken along the line 4—4 of FIG. 3.

Referring now to FIGS. 3 and 4, inverted "V"-shaped baffles 90, 91, 92, 93, 94, 95, 96, 97, 98, 99 and 100 are disposed on the casing bottom wall 63 between the outlet apertures 69 through 79, for channeling the air-fuel mixture to and through such outlet apertures. As aforementioned, a pressurized air blower 38 is provided having a pressurized air feeding duct 40 leading to the inlet apertures 81 through 88, for channeling pressurized air into the lower end of the tube 50 and thence upwardly past the edges of the table 52 through the passageway 53 and mixing with the pulverized fuel overflow from the table, thence flowing out the top of the upstanding hollow tube 50 between the tube 50 and the conduit 35 thence into the flow chamber 66 and out the flow chamber outlets 69, 70, 71, etc., to associated fuel burners.

The invention also contemplates methods of mixing pulverized fuel and air including feeding pulverized fuel onto a table 52 whereby the pulverized fuel spills off the edges of the table in predetermined amounts, supplying pressurized air from the blower 38 upwardly past the edges of the table 52 whereby such upwardly flowing air catches the pulverized fuel overflow from the table 52 and mixes therewith to form an air-fuel mixture, and channeling such air-fuel mixture to associated fuel burners.

In more detail, the method includes providing an upstanding hollow tube 50 forming an air-fuel mixing chamber 67 having therein a table 52 intermediate the top and bottom ends 62 and 63, respectively, thereof whereby at least some of the table edges are spaced from the walls of the tube 50 to provide an air passageway 53 therebetween, feeding pulverized fuel onto the table 52 and off the edges thereof in predetermined amounts, feeding pressurized air into the lower end of the tube 50 and thence upwardly past the table edges whereby such upwardly flowing air catches the pulverized fuel overflow from the table 52 and mixes therewith to form an air-fuel mixture, and channeling such air-fuel mixture from the tube 50 to associated fuel burners.

Thus, the invention provides air-fuel mixing device D for mixing solid pulverized fuel with air in preselected ratios prior to combustion including, an upstanding hollow tube 50 forming an air-fuel mixing chamber 67, a table 52 disposed in such tube 50 intermediate the top and bottom ends thereof whereby at least some of the table edges are spaced from the walls of the tube 50 to provide an air passageway 53 therebetween, fuel feeding means 34 for feeding pulverized fuel onto the table 52 and off the edges thereof in preselected amounts, air feeding means 38 for feeding pressurized air into the lower end of the tube 50 and thence upwardly past the table edges whereby such upwardly flowing pressurized air catches the pulverized fuel overflow from the table 50 and mixes therewith to form an air-fuel mixture, and tube outlet means (including the flow chamber 66 and the outlets 69 through 79) for channelling the air-fuel mixture from the tube 50 to associated fuel burners.

The terms and expressions which have been employed are used as terms of description, and not of limitation, and there is no intention, in the use of such terms and expressions, of excluding any equivalents of the features shown and described or portions thereof, but it is recognized that various modifications are possible within the scope of the invention claimed.

What is claimed is:

1. An air-fuel mixing device for mixing solid pulverized fuel with air in preselected ratios prior to combustion comprising, an upstanding hollow tube forming an air-fuel mixing chamber, a table disposed in said tube intermediate the top and bottom ends thereof whereby at least some of the table edges are spaced from the walls of the tube to provide an air passageway therebetween, fuel feeding means for feeding pulverized fuel onto the table and off the edges thereof in preselected amounts, air feeding means for feeding pressurized air into the lower end of the tube and thence upwardly past the table edges whereby such upwardly flowing pressurized air catches the pulverized fuel overflow from the table and mixes therewith to form an air-fuel mixture, and tube outlet means for channelling the air-fuel mixture from the tube to associated fuel burners.

2. The structure of claim 1 wherein said fuel feeder means includes a feed hopper containing pulverized fuel, and a fuel feeder operatively secured to the bottom of the hopper and having an outlet conduit extending into the top of said tube for feeding the pulverized fuel from the feed hopper and thence into the tube and onto the table in preselected amounts.

3. The structure of claim 2 wherein said fuel feeder is a rotary valve having a positive displacement type axially rotatable rotor, and variable speed drive means for selectively controlling the speed of rotation of said rotor for feeding pulverized fuel to said tube and table in predetermined amounts, said positive displacement rotor forestalling flow of the air-fuel mixture upwardly through the fuel feeder outlet conduit.

4. The structure of claim 1 wherein the tube outlet means includes an exterior casing having top, bottom and side walls forming a flow chamber; and said upstanding hollow tube is disposed in said flow chamber and secured substantially centrally to the bottom wall thereof, said casing bottom wall having at least one aperture adjacent its periphery forming a flow chamber outlet, whereby the air-fuel mixture flows out the top of the upstanding hollow tube thence into the flow chamber and out the flow chamber outlet to associated fuel burners.

5. The structure of claim 4 and further including an internal cone disposed interiorly of the flow chamber and secured to the exterior of the upstanding hollow tube, said cone extending downwardly and outwardly from the upper portion of the tube to a position adjacent the inner edge of the flow chamber outlet to channel the air-fuel mixture through the flow chamber and thence to the flow chamber outlet.

6. The structure of claim 5 wherein said upstanding hollow tube, said cone and said casing are annular; said casing bottom wall being annular and having a plurality of circumferentially disposed outer outlet apertures disposed adjacent the outer periphery of the casing bottom wall between the cone and the casing outer wall forming said flow chamber outlets; and said casing bottom wall having a plurality of circumferentially disposed inner inlet apertures disposed interiorly of the tube forming inlets for the pressurized air entering the lower end of the casing.

7. The structure of claim 6 and further including inverted "V"-shaped baffles disposed on the casing bottom wall between the outlet apertures for channeling the air-fuel mixture to and through the outlet apertures.

8. The structure of claim 6 wherein said table is annular and is spaced from and disposed centrally on the casing bottom wall interiorly of the inlet apertures with the edges of the table being spaced from the walls of the tube.

9. The structure of claim 6 wherein said air feeding means includes a pressurized air blower having a pressurized air feeding duct leading to said inlet apertures for channeling pressurized air into the lower end of the tube and thence upwardly past the table edges.

10. An air-fuel mixing device for mixing solid pulverized fuel with air in preselected ratios prior to combustion comprising, an annular upstanding hollow tube forming an air-fuel mixing chamber, an annular table disposed in said tube intermediate the top and bottom ends thereof whereby the table edges are spaced from the walls of the tube to provide an air passageway therebetween, a feed hopper containing solid pulverized fuel and disposed above said tube, a fuel feeder operatively secured to the bottom of the hopper and having an outlet conduit extending into the top of said tube for feeding the pulverized fuel from the feed hopper and thence into the tube and onto the table and off the edges thereof in preselected amounts, said fuel feeder being a rotary valve having a positive displacement type axially rotatable rotor, variable speed drive means for selectively controlling the speed of rotation of said rotor for feeding pulverized fuel to said tube and table in predetermined amounts, said positive displacement rotor forestalling flow of air-fuel mixture upwardly through the fuel feeder outlet conduit, an exterior annular casing having top, bottom and side walls forming a flow chamber, said upstanding hollow tube being disposed in said flow chamber and secured substantially centrally to the bottom wall thereof, said casing bottom wall being annular and having a plurality of circumferentially disposed outer outlet apertures disposed adjacent the other periphery of the casing bottom wall exteriorly of the tube forming flow chamber outlets, said casing bottom wall also having a plurality of circumferentially disposed inner inlet apertures disposed interiorly of the tube forming inlets for pressurized air entering the lower end of the tube, an annular internal cone disposed interiorly of the flow chamber and secured to the exterior of the upstanding hollow tube, said cone extending downwardly and outwardly from the upper portion of the tube to a position adjacent the inner edge of the flow chamber outlets to channel air-fuel mixture through the flow chamber and thence to the flow chamber outlets, inverted "V"-shaped baffles disposed on the casing bottom wall between the outlet apertures for channeling the air-fuel mixture to and through the outlet apertures, said table being spaced from the casing bottom wall, and a pressurized air blower having a pressurized air feeding duct leading to said inlet apertures for channeling pressurized air into the lower end of the tube and thence upwardly past the table edges and mixing with the pulverized fuel overflow from the table thence out the top of the upstanding hollow tube thence into the flow chamber and out the flow chamber outlets to associated fuel burners.

* * * * *